US005913812A

United States Patent [19]

Smith et al.

[11] Patent Number: 5,913,812

[45] Date of Patent: Jun. 22, 1999

[54] STEAM SEAL AIR REMOVAL SYSTEM

[75] Inventors: James S. Smith, Old Lyme; Glenn N. Levasseur, Colchester; John H. Chapman, Groton; Daniel J. Link, No. Stonington; Kevin M. Didona, East Lyme, all of Conn.

[73] Assignee: Electric Boat Corporation, Groton, Conn.

[21] Appl. No.: 08/843,852

[22] Filed: Apr. 17, 1997

Related U.S. Application Data

[62] Division of application No. 08/488,299, Jun. 7, 1995, Pat. No. 5,749,227.

[51] Int. Cl.[6] ..... F01B 31/00

[52] U.S. Cl. ..... 60/657; 277/419

[58] Field of Search ..... 60/657; 277/419, 277/370, 379, 411, 412

[56] References Cited

U.S. PATENT DOCUMENTS

| | | | |
|---|---|---|---|
| 885,651 | 4/1908 | Scott . | |
| 1,331,360 | 2/1920 | Parsons et al. . | |
| 1,331,522 | 2/1920 | Parsons et al. . | |
| 1,374,520 | 4/1921 | Parsons . | |
| 1,562,019 | 11/1925 | Wilkinson . | |
| 1,851,946 | 3/1932 | Krugman . | |
| 2,008,527 | 7/1935 | Warren | 277/419 |
| 2,175,868 | 10/1939 | Bentley | 286/8 |
| 2,543,615 | 2/1951 | Trumpler | 286/11.11 |
| 3,035,842 | 5/1962 | Gilbert | 277/92 |
| 3,604,206 | 9/1971 | Baily | 60/108 |
| 3,689,047 | 9/1972 | Grosko | 266/34 V |
| 4,061,894 | 12/1977 | Crouch | 200/144 B |
| 4,079,217 | 3/1978 | Oeschger | 200/144 B |
| 4,170,364 | 10/1979 | Remberg et al. | 277/53 |
| 4,238,109 | 12/1980 | Powers | 251/28 |
| 4,319,240 | 3/1982 | Stone et al. | 340/856 |
| 4,517,804 | 5/1985 | Ura et al. | 60/657 |
| 5,014,881 | 5/1991 | Andris | 222/207 |
| 5,217,232 | 6/1993 | Makhobey | 277/26 |
| 5,344,160 | 9/1994 | Scarlata et al. | 277/3 |

FOREIGN PATENT DOCUMENTS

| | | |
|---|---|---|
| 1542483 | 3/1979 | United Kingdom . |

*Primary Examiner*—Noah P. Kamen
*Attorney, Agent, or Firm*—Baker & Botts LLP

[57] ABSTRACT

A turbine air sealing and condenser air removal system for use in steam plant equipment is arranged to increase steam plant efficiency, reduce oxygen concentration in condensate being returned to the steam generators, and simplify system arrangement and maintenance. This system incorporates dry running shaft seals at the high and low pressure turbine shaft glands. The turbine shaft glands are exhausted to a vacuum header which is exhausted by vacuum pumps. Air from the condenser is also exhausted to the common vacuum header. Non-rotating air seals on the turbine such as valve stem seals, which must only accommodate linear movement, can incorporate metallic bellows or conventional packings to prevent air leakage into the steam path or steam leakage out into the surrounding environment. The bellows seals may also incorporate stem glands which are exhausted to the turbine exhaust trunk to minimize the internal pressure of the bellows and prevent catastrophic failure which might occur if the bellows were to be pressurized with high pressure steam.

5 Claims, 5 Drawing Sheets

STEAM SEAL AIR REMOVAL SYSTEM

This is a divisional of Ser. No. 08/488,299, filed Jun. 7, 1995, now U.S. Pat. No. 5,749,227.

BACKGROUND OF THE INVENTION

This invention relates to a turbine sealing and air removal arrangement which provides for conducting exhaust from both ends of a turbine to a common vacuum header which also exhausts air from a condenser. More particularly, this invention relates to a turbine sealing and air removal arrangement for steam turbines which reduces the oxygen concentration in the condensate being returned to the steam generators, reduces maintenance, increases efficiency and simplifies system arrangement. This invention also relates to a turbine sealing and air removal arrangement incorporating a metallic bellows valve stem seal which is exhausted to a turbine exhaust trunk to minimize the internal pressure of the bellows and prevent catastrophic failure.

Most conventional steam turbine air sealing/condenser air removal systems are based on labyrinth type turbine rotor gland seals and steam jet type air ejectors for exhausting air which leaks into the turbine glands and the condenser. In the interest of minimizing steam consumption by the steam jet air ejectors, two separate exhaust systems are typically used for turbine rotor gland and condenser air exhausting. Two separate systems are required due to the fact that condenser pressure must be maintained as low as possible, e.g., 0.5 to 10 inches Hg Absolute for best steam cycle efficiency, while the outermost turbine rotor glands must be maintained at slightly below atmospheric pressure in order to prevent steam from leaking out of the turbine casing. The turbine glands in such systems also require that sealing steam be provided during start-up and at low power conditions to preclude air from entering the condenser. This sealing steam requires still another piping system to be installed and maintained. This system and the steam supply to the steam jet air ejectors typically require that reducing or pressure regulating valves be used, which unfortunately are subject to steam erosion at the throttling element of the valves. These regulating valves are commonly the source of unplanned maintenance and plant downtime.

The steam sealing system also requires the use of a turbine rotor turning gear that slowly rotates the rotor during start-ups from cold iron and during temporary shut-downs to prevent bowing of the turbine rotor due to differential thermal expansion. The rotor turning gear is another high maintenance item that is also the source of many operator errors for example, admitting steam while the rotor is on turning gear. Operation of the rotor turning gear is reputed to be the cause of over 90% of all turbine bearing wear since the slow rotation of the rotor is insufficient to develop an oil film which, at normal operating speeds, prevents the bearing surfaces from contacting. For the reasons noted above, power generating stations which employ steam turbines have historically required constant attention by at least one skilled operator. This is particularly undesirable in remote steam power applications where small to medium units must be operated in relatively unprotected environments such as petroleum distillation plants. The recent proliferation of small to medium size cogeneration plants has also demonstrated the need for steam equipment which can be operated unattended for months or years with only occasional planned maintenance being required and minimal capitol investment at installation.

SUMMARY OF THE INVENTION

Accordingly, it is an object of the invention to provide a turbine air sealing and condenser air removal system for use in steam cycle power generating equipment which is more efficient, less complex and less expensive to install and maintain than systems currently in use. The alternate system uses a common vacuum header for condenser air removal and turbine rotor gland exhaust. The turbine rotor glands incorporate dry running seals to prevent excessive air/steam leakage into the vacuum header. Other steam/air seals such as at the valve stems may include conventional packings or metallic bellows, which provide an absolute, low maintenance seal.

Another object of this invention is to provide a dry running turbine shaft seal configuration which allows easy replacement of seal elements when they become worn.

Another object of this invention is to provide a, metallic bellows type valve stem seal which is a near absolute, long life seal and is exhausted to vacuum such that failure of the bellows is uneventful.

These and other objects of the invention are attained by providing a power generation system including a vapor generation system feeding at least one turbine, each turbine comprising a rotor and sealing system including turbine rotor glands located along the rotor, at least one condenser which condenses vapor from at least one turbine and a common vacuum header. The common vacuum header exhausts air from the turbine rotor glands thereby preventing the air from mixing with vapor in the turbine and entering the condenser. The common vacuum header is exhausted by an evacuation device. This system minimizes the amount of dissolved gases in the condensate returning to the vapor generation system.

The invention further provides a turbine rotor seal arrangement including at least one row of stationary circumferential sealing elements arranged for sliding contact with a cylindrical portion of a turbine rotor. A spring arrangement holds the rotor seal in place with respect to the turbine rotor. A split housing surrounds the sealing elements and can be removed while the sealing elements remain in contact with the turbine rotor. Such an arrangement allows for easy repair and replacement of seal elements.

The invention also provides a metallic bellows valve stem seal including a valve stem which extends from a high pressure containment through one or more close clearance bushings and through a metallic bellows seal into a low pressure zone surrounding the high pressure containment. The metallic bellows stem seal is substantially attached to the valve stem and the containment so as to effectively form a static fluid seal at each point of attachment. The internal pressure of the bellows is reduced below the pressure in the high pressure containment by a leak-off connection which exhausts fluid leaking past the one or more close clearance valve bushings.

The invention further provides for a turbine rotor gland arrangement having an outermost seal and an inner seal including one or more labyrinth type seals. The gland formed between the inner and outermost seal is exhausted so as to maintain pressure in the gland at or below the pressure outside the outermost seal. The outermost seal includes two rows of circumferential dry running sealing elements. The outer row of sealing elements prevents air leakage into the turbine while the inner row prevents leakage out of the turbine in the event that the pressure in the gland becomes greater than the pressure outside the outermost seal.

BRIEF DESCRIPTION OF THE DRAWINGS

Further objects and advantages of the present invention will be more fully appreciated from a reading of the following detailed description when considered with the accompanying drawings wherein.

DESCRIPTION OF THE PREFERRED EMBODIMENTS

Figure 1:
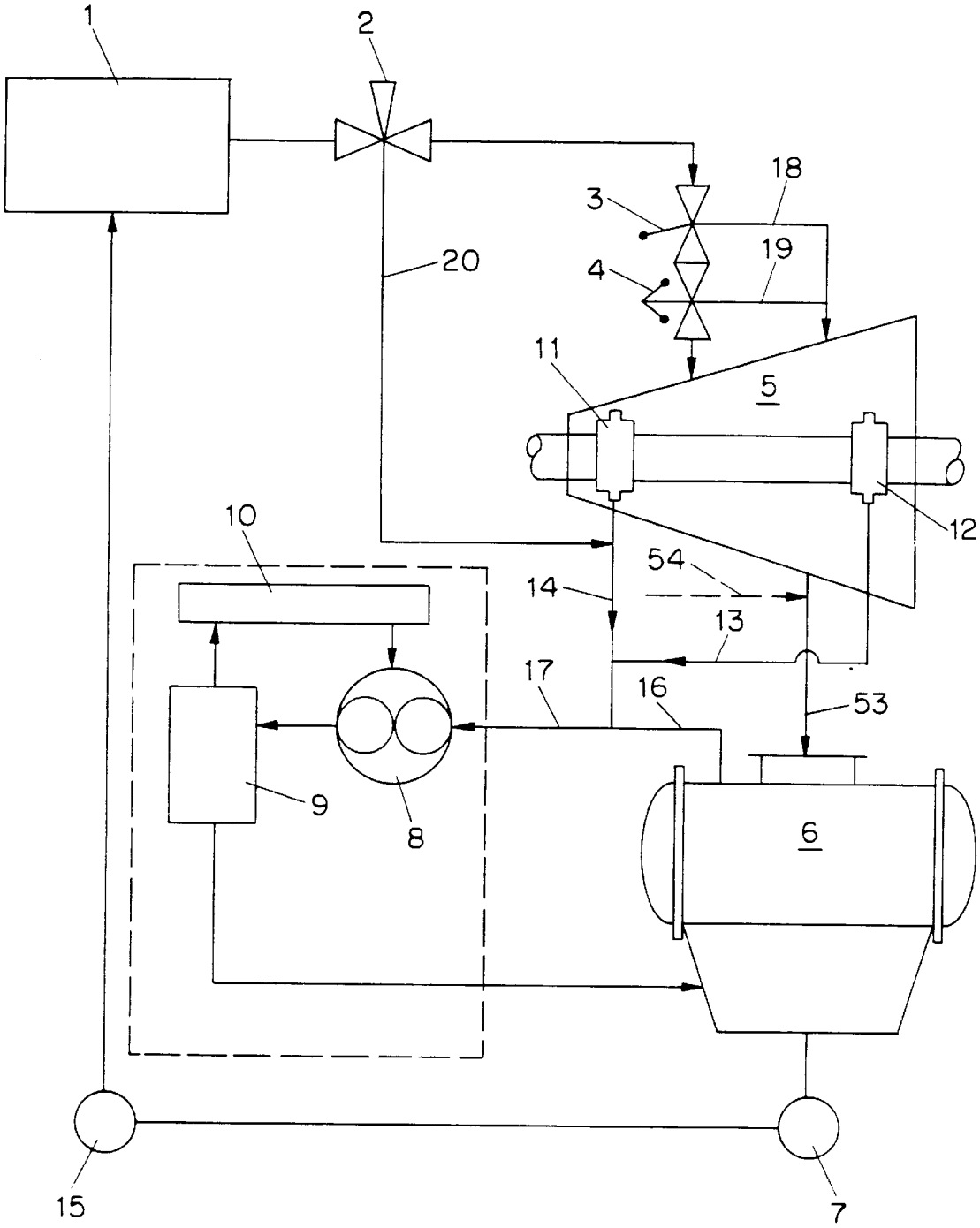
FIG. 1 is a schematic representation of a typical embodiment of a power generation system arranged in accordance with the invention.

In accordance with the representative embodiment of the invention schematically shown in FIG. 1 a vapor such as steam is supplied to a turbine. In that embodiment, the basic system consists of a steam generator 1 which provides steam to a turbine 5 via various isolation valves 2, trip throttle valves 3 and governor valves 4. Exhaust from the turbine 5 enters a main condenser 6 where the exhaust vapor is condensed and returned to the steam generator 1 by condensate pumps 7 and feed water pumps 15.

In steam plants such as shown in FIG. 1, an arrangement for preventing steam leakage at valve stems and where the turbine rotor exits the high pressure end of the turbine casing is an obvious necessity. Additionally, an arrangement for preventing air leakage into the low pressure turbine exhaust or the main condenser, which will typically operate 20 to 29 inches Hg below atmospheric pressure, must be incorporated. This is necessary because air, or any non-condensable gas in the exhaust vapor will accumulate around the condenser tubes as the moisture in the air/vapor mixture condenses out, creating a boundary layer that impairs heat transfer and overall condenser performance. Oxygen and other gases in the air can also become dissolved in the condensate in high concentrations if the amount of air in the condenser in excessive. These gases, particularly oxygen, can cause corrosion problems in the steam generator 1, and other portions of the system if they are not removed on a continuous basis by use of feedwater chemical additives or deaeration tanks. Air can enter the turbine exhaust where the turbine rotor exits the low pressure casing under normal operating conditions, and any other location where pressures below atmospheric are encountered. Conventional steam sealing systems use low pressure exhaust systems almost exclusively to eject air entering the outermost gland at every mechanical penetration, e.g., valve stems, turbine rotors, etc., in the steam path. The air/vapor mixture coming from these glands is ultimately routed to an auxiliary condenser where the air is exposed to ideal conditions for diffusion of gases into condensate forming on the condenser tubes. Air which does not dissolve into the condensate will accumulate near the high points of the auxiliary condenser which are vented to atmosphere or must be ejected by some evacuation method to prevent the condenser from becoming air-bound.

As shown in FIG. 1, in accordance with the invention air is removed from the main condenser 6 by a vacuum pump 8 via an exhaust line 16 which is connected to a common vacuum header 17. The vacuum pump discharges an air/vapor mixture drawn in from the vacuum header to a moisture separator 9, where moisture in the air/vapor mixture is separated and collected and relatively dry air is vented to the atmosphere. The collected moisture is typically returned to the condenser hotwell by a drain line. The drain line is opened by a float valve when the level in the moisture separator tank gets too high.

In an alternate embodiment a steam jet type air ejector may be used to evacuate the vacuum header. In that case the vacuum header discharges into an auxiliary condenser as described above to separate moisture from the air/vapor mixture. Steam jet ejectors are typically far less efficient than vacuum pumps and add a considerable amount of heat and moisture to the air/vapor mixture coming in from the vacuum header. This additional heat and moisture necessitates the use of a sizable auxiliary condenser to remove moisture from the air, rather than a simple moisture separator. This sizeable auxiliary condenser has a large tube bundle surface area, where condensate is formed in contact with high concentrations of oxygen and other non-condensable gases, and thus will return a larger quantity of condensate to the main condenser, which promotes greater oxygenation of feed water. In contrast vacuum pump moisture separators have a very small surface area where precipitated moisture is exposed to oxygen and other non-condensable gases. These separators need only remove moisture coming in with the air/vapor mixture from the vacuum header since the vacuum pump does not add vapor to the mixture as do steam ejectors. The vacuum pumps, which are typically conventional liquid ring type, require a small heat exchanger 10 to keep the liquid ring-and moisture separator cool.

The steam plant air sealing and removal system shown in FIG. 1 includes two turbine rotor glands 11 and 12. These glands are formed by incorporating a low leakage air seal where the turbine rotor exits the turbine casing. The glands are connected to two exhaust lines 13 and 14 just inside the low leakage air seals forming the glands. The exhaust lines 13 and 14 are routed to the common vacuum header 17. Conventional turbine steam/air sealing systems use labyrinth type seals, which allow a considerable amount of air leakage, dictating the use of a dedicated turbine gland exhaust system. Simple carbon packing rings are sometimes used, which do not require a dedicated turbine gland exhaust system, but are limited to small turbine rotors. These simple carbon rings allow a nominal amount of steam leakage out past the high pressure gland and a nominal amount of air leakage in past the low pressure gland, which enters directly into the condenser with turbine exhaust.

These low leakage air seals, which are described in more detail below, allow a nominal amount of air leakage into the turbine glands. At high power levels, steam leakage from the first stage of the turbine 5 into the high pressure gland 11 is common. It is preferable to exhaust the air/steam mixture from the turbine glands via the exhaust lines 13 and 14 to the common vacuum header 17 so that air entering the turbine glands is exhausted to atmosphere before it has a chance to enter the main condenser and become dissolved in the condensate or impair heat transfer. However, if the steam leakage from the first stage of the turbine 5 is too excessive for a vacuum pump 8, moisture separator 9 and heat exchanger 10 of a reasonable size, and the air leakage into the turbine glands is within acceptable limits for the main condenser 6 to accept, the turbine gland exhaust lines 13 and 14 can be routed directly to a turbine exhaust 53 via a separate exhaust line 54 or via passages internal to the turbine casing structure. In either case, the need for dedicated turbine gland sealing and exhaust systems, as required in conventional steam plants, is eliminated.

The valve stem seals for the system shown in FIG. 1 may be of a conventional soft packing type with exhaust lines 18, 19 and 20 preferably running to the vacuum header 17. These exhaust lines may also run to the turbine exhaust as shown for exhaust lines 18 and 19, since the air leakage through these paths will be negligible in most cases. Soft packing type valve stem seals may also be incorporated which do not use exhaust lines 18, 19 and 20. In that case, however, steam will leak out from these seals as the packings wear.

The present invention provides for an absolute air seal in the form of a metallic bellows seal, which can also function to seal internal steam pressure if desired. A metallic bellows seal may also be connected to exhaust lines 18, 19 and 20 to reduce internal pressure and hence, mechanical stress on the bellows, which determines bellows fatigue life. However, no air leakage is expected to occur. In this case, air contribution by exhaust lines 18 and 19 will be non-existent and a failure of a bellows will be uneventful relative to a failure of a bellows seal under high internal steam pressure, with the exception of a slight increase in condenser air concentration or possibly generation of a whistling tone.

Figure 2:
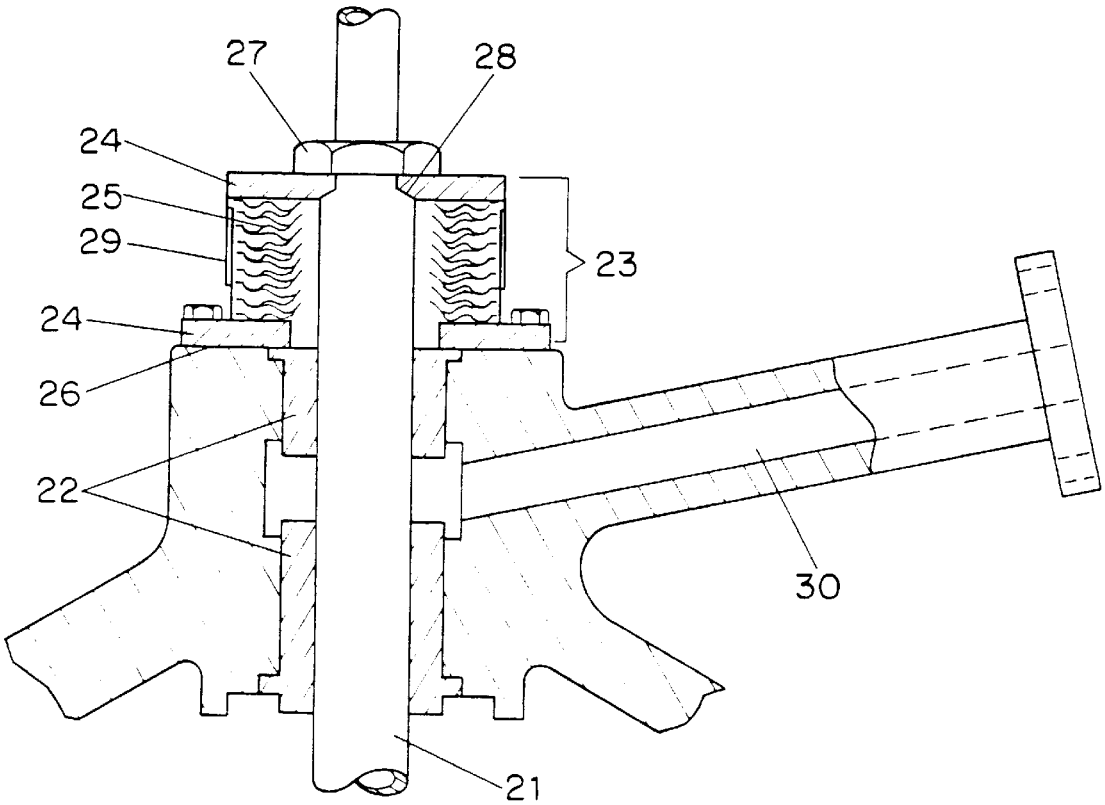
FIG. 2 is a sectional view of a metallic bellows seal in accordance with the invention.

FIG. 2 is a cross-section of a metallic bellows valve stem seal in accordance with the invention which is compatible with the steam plant air sealing and exhaust system described above. The valve stem 21 is capable of linear motion only, i.e., no rotation is possible, through bushings 22, which is the case for most root valve, trip throttle valve and governing valve stems. A bellows assembly 23 and upper and lower flanges 24 are attached to the valve bonnet by threaded fasteners and to the valve stem 21 by a nut 27. The upper flange seats on a tapered valve stem portion 28 to form a metal-to-metal seal, but may also incorporate a compressible gasket or packing for improved tightness if an acceptable surface finish on the seating surfaces of the upper flange and the valve stem taper 28 cannot be maintained. The lower flange is sealed against the valve bonnet using a compressible gasket, which may also be implemented as a metal-to-metal seal for simplicity, provided surface finishes are adequate on the mating surfaces. Preferably, the metallic bellows 25 is a welded type fabricated from formed convolutions of thin sheet metal. The metallic bellows 25 may also be formed from a continuous tube or electro-formed into the final shape required. The material for the bellows convolutions must be suitable for high temperature, high stress, high fatigue conditions such as NiCrFe, other nickel alloys or the like. The bellows convolutions must be protected from mechanical damage and from foreign objects which may become lodged between the convolutions and cause high stresses when the bellows is compressed. Therefore, a telescoping guard 29 is provided, which consists of two or more concentric tubes connected to the upper and lower flanges 24. The internal pressure of the bellows is reduced to less than three atmospheres (absolute pressure), preferably to atmospheric pressure or below, by connecting a leak-off connection 30 to the vacuum header 17 as shown on FIG. 1 or to the turbine exhaust casing. Reducing the internal pressure, which would ordinarily reach steam supply pressure, typically several hundred PSI, without the leak-off 30, reduces stress on the bellows convolutions which increases bellows fatigue life. Since the bellows provide a near absolute air seal, the leak-off 30 represents no threat of increased air leakage unless a bellows failure were to occur. Even in that case, the additional air leakage should be minimal. Incorporation of the leak-off 30 ensures that a bellows failure will be uneventful, since only a small amount of air leaking into the bellows will occur. This leakage is negligible compared to the large amount of steam leaking out of the bellows which would occur if this leak-off were not incorporated in the metallic bellows.

Figure 3:
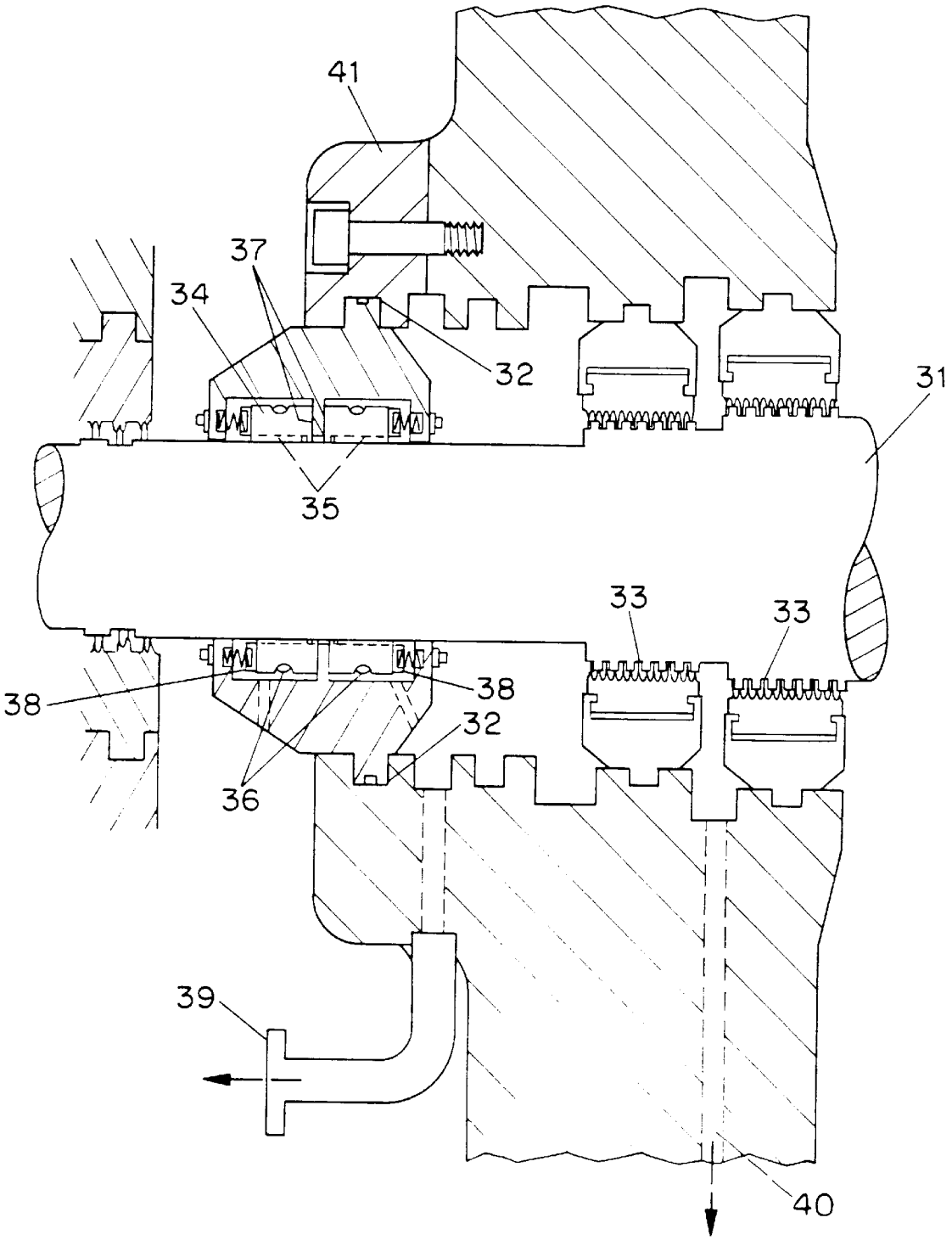
FIG. 3 is a sectional view of a turbine rotor seal arrangement in accordance with the invention for the high and low pressure end of a turbine.

A cross-section of a typical turbine rotor air seal for incorporation in the turbine air sealing/condenser air removal system shown in FIG. 1 is shown in FIG. 3. The outermost gland formed around the turbine rotor 31 is bounded by a dry running air seal assembly 32 and labyrinth seals 33. The dry running seal has sealing elements which include stationary carbon segments 34 arranged circumferentially around the turbine rotor 31. External air pressure and garter springs 36 cause the carbon segments 34 to be seated against the turbine rotor 31 while pressure venting grooves 35 act to reduce the unit load on the circumferential sealing surface. In this manner wear life of the carbon seal elements is maximized. The carbon segments are seated axially against a radial seal surface 37 by external pressure and compression springs and spring plates 38. This seal configuration provides a duplex seal capable of preventing air leakage from the atmosphere on the left side of the seal to the gland on the right side, during normal operation, or sealing against steam pressure which may build-up in the gland on the right side of the seal under a failure condition such as loss of cooling water to the condenser, so that steam will not be released to the surroundings and endanger personnel.

In an embodiment wherein the seal configuration shown in FIG. 3 is implemented on the high pressure end of the turbine rotor the first stage of the turbine is just to the right of the labyrinth seals 33. In that case the gland formed between the dry running seal assembly 32 and the labyrinth seals 33 is exhausted to the vacuum header 17 or to the turbine exhaust 53 shown on FIG. 1 via an exhaust connection 39. The gland formed between the labyrinth seals 33 is exhausted to a downstream stage of the turbine, e.g., stage 4 or 5, via a packing re-entry passage 40 in order to make use of high pressure steam leaking from the first stage area to the right of the labyrinth seals 33. A flow restricting device, for example an orifice, may be incorporated at the exhaust connection 39 to raise gland pressure under high power operation. This will decrease differential pressure across the dry running seal and as such, will decrease unit loading on the seal faces, thus increasing the wear life of the seal elements. Decreased differential pressure will also minimize steam leakage from the packing re-entry gland or the first stage area across the labyrinths which will improve steam plant efficiency.

In an embodiment wherein the seal configuration shown in FIG. 3 is implemented on the low pressure end of the turbine rotor, the turbine exhaust is just to the right of the labyrinth 33. In that case the exhaust connection 39 is connected to the vacuum header 17 shown on FIG. 1. Alternately, the exhaust connection 39 may be omitted entirely if the air leakage past the dry running seal assembly 32 is low enough for the condenser exhaust connection 16 shown on FIG. 1, to maintain condenser air concentrations within acceptable limits. The labyrinth seals 33 may also be omitted. However, retaining at least one labyrinth provides a back-up seal which can prevent complete loss of condenser vacuum if the sealing elements 34 in the dry running seal assembly 32 were to catastrophically fail. The packing re-entry passage 40 does not serve any purpose at the low pressure end of the turbine rotor, and as such, may be omitted.

Although other types of dry running seals can be incorporated for turbine rotor gland air sealing such as non-contacting face seals, lip seals, various types of flexible circumferential seals, etc., the dry running seal configuration shown in FIG. 3 is preferable for many reasons. As shown, the dry running seal assembly 32 fits within the packing box constraints defined for the conventional labyrinth seal assemblies that are used in conventional air removal systems. In fact, if the grooves in the turbine rotor that would normally be incorporated to accommodate the teeth of the outermost labyrinth seal are machined away, a dry running seal configuration as shown in FIG. 3 can be backfit into an existing turbine. This seal can also accommodate almost unlimited axial movement of the turbine rotor relative to the turbine casing which is sometimes encountered due to differential thermal expansion of the rotor and casing.

Figure 4A:
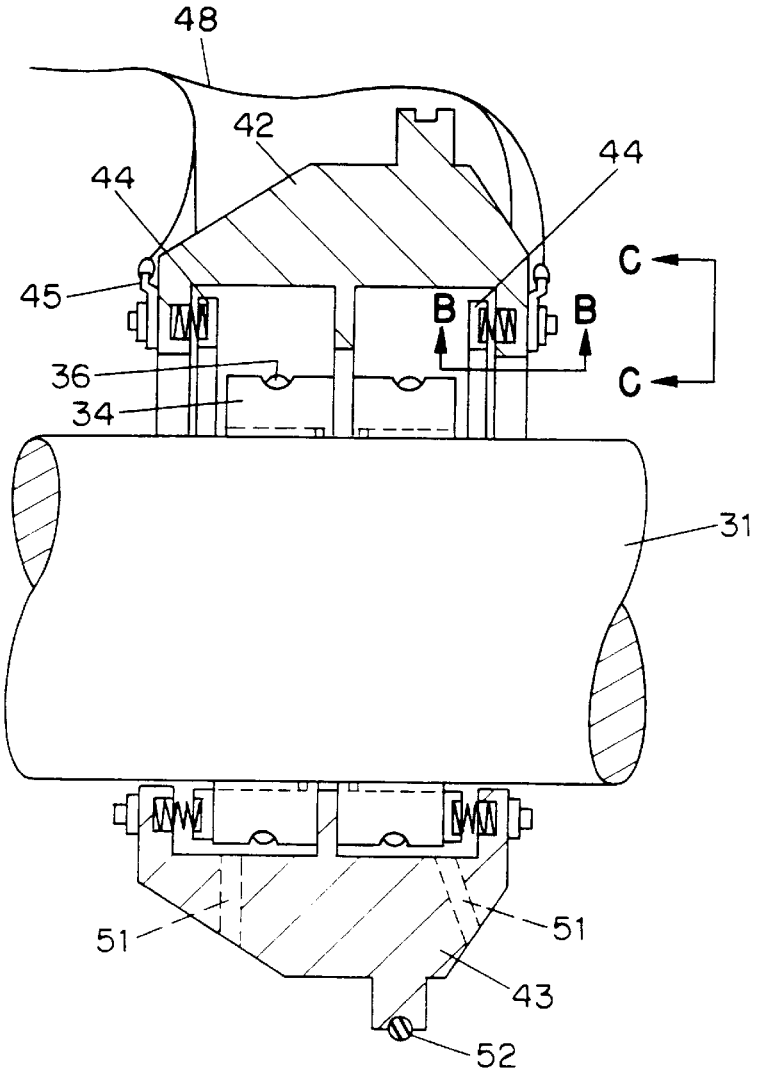
FIG. 4A is an enlarged sectional view showing the turbine rotor seal arrangement at the high pressure end of the turbine depicted in FIG. 3.
Figure 4B:
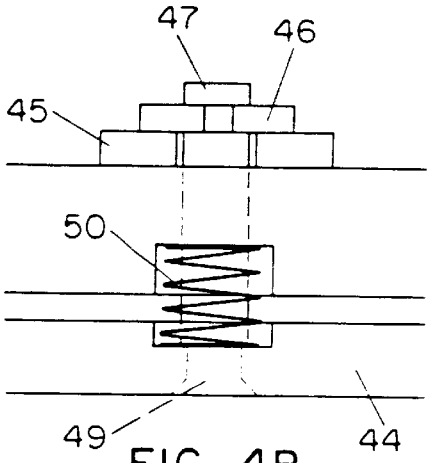
FIG. 4B is an exploded sectional view taken along line B—B of FIG. 4A.
Figure 4C:
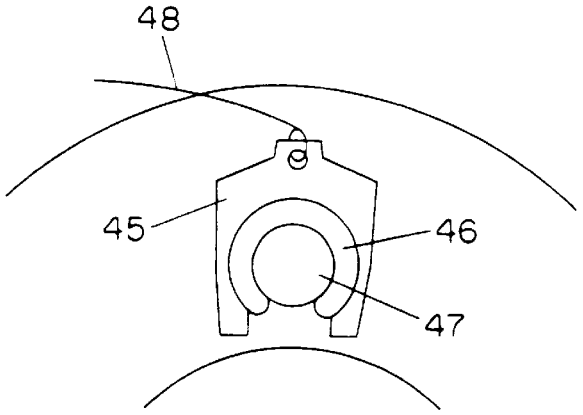
FIG. 4C is an exploded sectional view taken along line C—C of FIG. 4A.

The dry running seal assembly 32 shown in FIG. 3 also permits replacement of the carbon segments with minimal disassembly of the packing box. By removing a packing box cap 41, access to the entire seal assembly is provided. As shown in FIG. 4, once the packing box cap 41 shown in FIG. 3 is removed, the upper half of a seal assembly 42 can be removed, allowing access to the seal elements 34. Detaching the garter spring 36 allows each individual carbon segment to be replaced. This can be accomplished without removing the lower half of the seal assembly 43 by rolling the worn segments out from around the turbine rotor and rolling the new segments in underneath the turbine rotor.

Once the new segments 34 are installed and the garter spring 36 is reattached, the upper seal housing 42 can be replaced. To prevent interference of the spring plates 44 with the seal segments 34 when the upper seal housing is lowered down onto the lower seal housing 43, shims 45 are placed in behind retaining rings 46 which capture retaining pins 47 to the seal housings 42 and 43. The shims 45 spread the spring plates 44 so that a clearance will be present when the upper seal housing 42 is lowered down onto the lower seal housing. The shims 45 are removed once the upper half seal housing is in place by pulling on a lanyard 48.

Each pin 47 is secured to a corresponding spring plate 44 by an integral rivet 49 which is machined flush with the spring plate 44 as shown. The pin 47 passes through a spring 50 so that the spring is physically captured and cannot be lost when the seal housings are removed.

The lower seal housing 43 also incorporates drainage passages 51 to permit any moisture which may collect at the low points of the seal housing to be carried away. A soft packing 52 may also be incorporated around the outside of the seal housing to minimize leakage. This soft packing must be split in order to allow removal of the upper housing 42.

Figure 5:
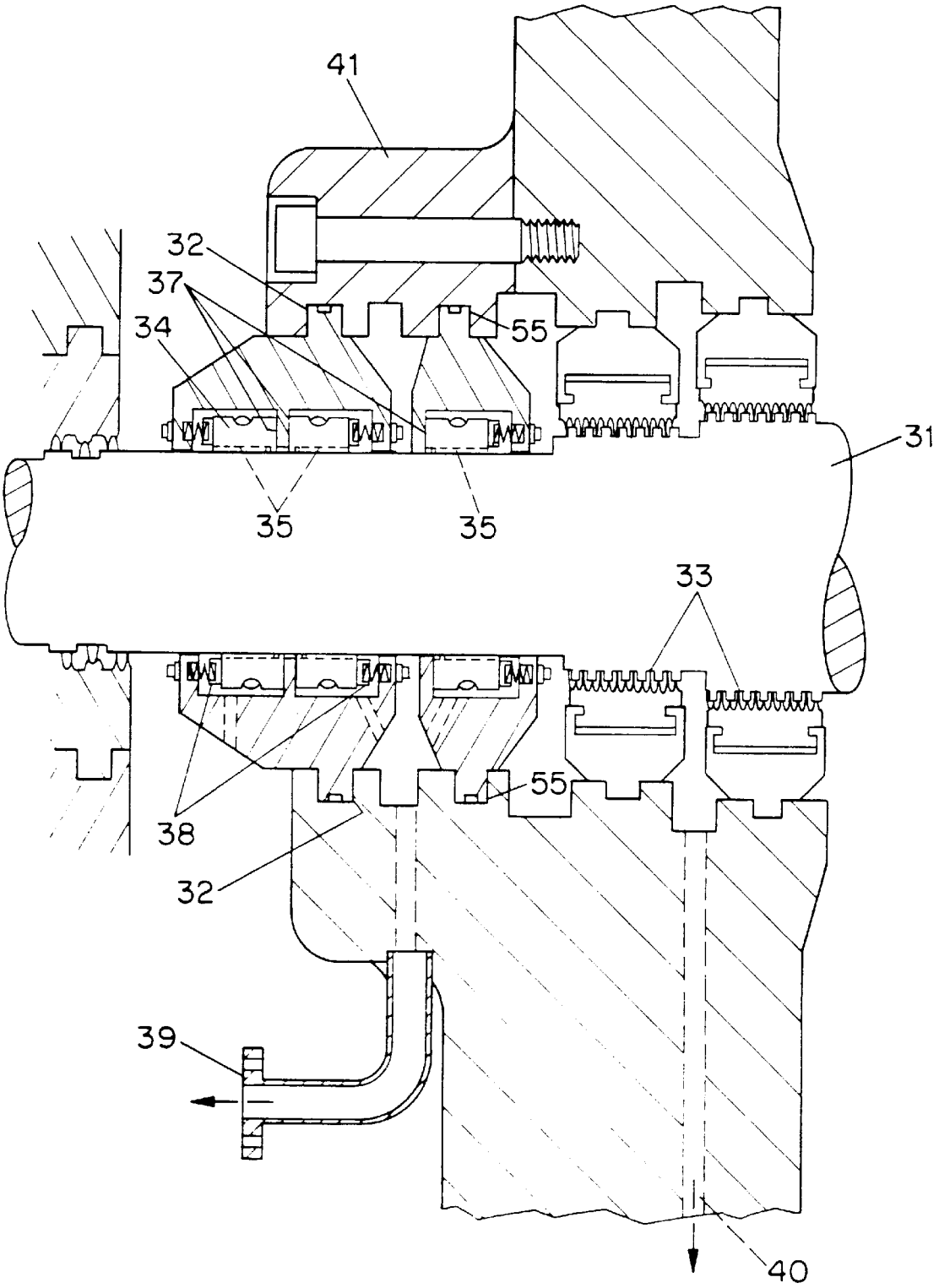
FIG. 5 is a sectional view of a turbine rotor seal arrangement in accordance with another typical embodiment of the invention.

An alternate embodiment of a turbine rotor seal arrangement for implementation on the high pressure end of a turbine is shown in FIG. 5. In this arrangement, the high pressure gland is provided with a low leakage air seal 32 outside the gland and a low leakage steam seal 55 on the inside of the gland. The low leakage air seal 32 is used to reduce air leakage into the vacuum header 17 or turbine exhaust 53 of FIG. 1 as previously described. The low leakage steam seal 55 is used to reduce steam leakage into the high pressure gland from the first stage of the turbine 5 and consequently into the vacuum header 17. This reduction in steam flow reduces the heat load required to be condensed by the vacuum pump heat exchanger 10. This reduction in steam flow also reduces the total flow capacity that the vacuum pump 8 must be sized to accept and improves steam plant efficiency by minimizing steam leakage out of the turbine under high power operation. The method of retention of the steam seal carbon segments, as well as installation and replacement is similar to that described above for the air seal assembly 32.

In summary, the present invention provides a simplified arrangement, a method for preventing steam leakage out of, minimizing air leakage into, and removing air from a conventional steam plant which requires minimal operator attention, and substantially reduced capitol investment and maintenance costs with respect to conventional steam seal/air exhaust systems. The valve stem bellows seal provides an absolute, long life air/steam seal with easy access to the bellows, while the turbine rotor seal provides an easily maintainable gland configuration with sealing elements which have a very predictable, repeatable wear life.

Although the invention has been described herein with reference to specific embodiments, many modifications and variations therein will readily occur to those skilled in the art. For example, the turbine rotor seals, power generation system, and metallic bellows described herein are equally useful for turbines which utilize fluids other than steam.

We claim:

1. A turbine rotor seal arrangement comprising at least one row of stationary circumferential sealing elements arranged for sliding contact with a cylindrical portion of a turbine rotor, a spring means for holding the turbine rotor seal in place with respect to the turbine rotor, and a split seal housing surrounding the sealing elements which can be removed while the sealing elements remain in contact with the turbine rotor.

2. A turbine rotor seal arrangement as claimed in claim 1 wherein the seal housing is arranged such that all spring means associated with the seal housing are physically captured in the seal housing, and wherein the spring means are temporarily retained by retaining means in a retracted position during installation of the seal housing.

3. A turbine rotor gland arrangement comprising a gland having an outermost bidirectional seal on one side including two rows of circumferential dry running seal elements, the outer row of sealing elements acting to prevent air leakage into the turbine and the inner row of sealing elements acting to prevent leakage out of the turbine in the event that the pressure in the gland becomes greater than the pressure outside the outermost seal and an inner seal comprising at least one labyrinth type seal on the other side, and an arrangement for exhausting the gland so as to maintain pressure in the gland at or below the pressure outside the outermost seal.

4. A turbine rotor gland arrangement as claimed in claim 3 wherein the outermost seal includes two rows of circumferential dry running sealing elements, the outer row of sealing elements acting to prevent air leakage into the turbine and the inner row of sealing elements acting to prevent leakage out of the turbine in the event that the pressure in the gland becomes greater than the pressure outside the outermost seal.

5. A turbine rotor gland arrangement as claimed in claim 3 or claim 4 where at least one of the inner seals further includes a close clearance dry running seal which acts to prevent leakage from within the turbine into the gland.

* * * * *